United States Patent [19]

Wikström

[11] Patent Number: 4,505,204

[45] Date of Patent: Mar. 19, 1985

[54] DRIVE ELEMENT FOR A SUB-CALIBRE PROJECTILE

[75] Inventor: Arne Wikström, Skellefteå, Sweden

[73] Assignee: Aktiebolaget Bofors, Bofors, Sweden

[21] Appl. No.: 495,388

[22] Filed: May 17, 1983

[30] Foreign Application Priority Data

May 28, 1982 [SE] Sweden ..... 8203313

[51] Int. Cl.[3] ..... F42B 13/16

[52] U.S. Cl. ..... 102/523

[58] Field of Search ..... 102/520–523

[56] References Cited

U.S. PATENT DOCUMENTS

| | | | |
|---|---|---|---|
| 2,382,152 | 8/1945 | Jakobsson | 102/523 |
| 3,745,926 | 7/1973 | Mertz et al. . | |
| 3,771,458 | 11/1973 | Schweimler et al. | 102/523 |
| 4,015,527 | 4/1977 | Evans | 102/703 |
| 4,043,269 | 8/1977 | Ambrosini | 102/523 |
| 4,140,061 | 2/1979 | Campoli | 102/521 |

FOREIGN PATENT DOCUMENTS

| | | |
|---|---|---|
| 172623 | 8/1960 | Sweden . |
| 320606 | 11/1970 | Sweden . |
| 374816 | 3/1975 | Sweden . |
| 585794 | 2/1947 | United Kingdom . |
| 1224362 | 3/1971 | United Kingdom . |
| 1335076 | 10/1973 | United Kingdom . |
| 1362308 | 8/1974 | United Kingdom . |
| 1417216 | 12/1975 | United Kingdom . |
| 2027855 | 2/1980 | United Kingdom . |

*Primary Examiner*—Harold J. Tudor

*Attorney, Agent, or Firm*—Pollock, Vande Sande & Priddy

[57] ABSTRACT

The invention relates to a drive element (1) for a sub-calibre spinning projectile (2). The drive element (1) comprises an annular sabot member (17) applied on the rear part of the projectile (2) and a guiding sleeve (7) of full-calibre substantially embracing the projectile (2) as well as the sabot member (17). The guiding sleeve (7) is provided with an external driving band (9) made directly in the sleeve material and internal threads coacting with corresponding threads (18) of the sabot member (17). The front part of the sabot member is provided with a central, axial hollow (20) for the rear part of the projectile comprising a plurality of axially extending locking pins (22) arranged to engage corresponding recesses (6) made in the outer cylindrical surface of the projectile close to its rear end surface (5) to secure the projectile (2) to the sabot member (17). The guiding sleeve is made of a high-strength material of low density, preferably a glass-fibre reinforced polyamide.

5 Claims, 1 Drawing Figure

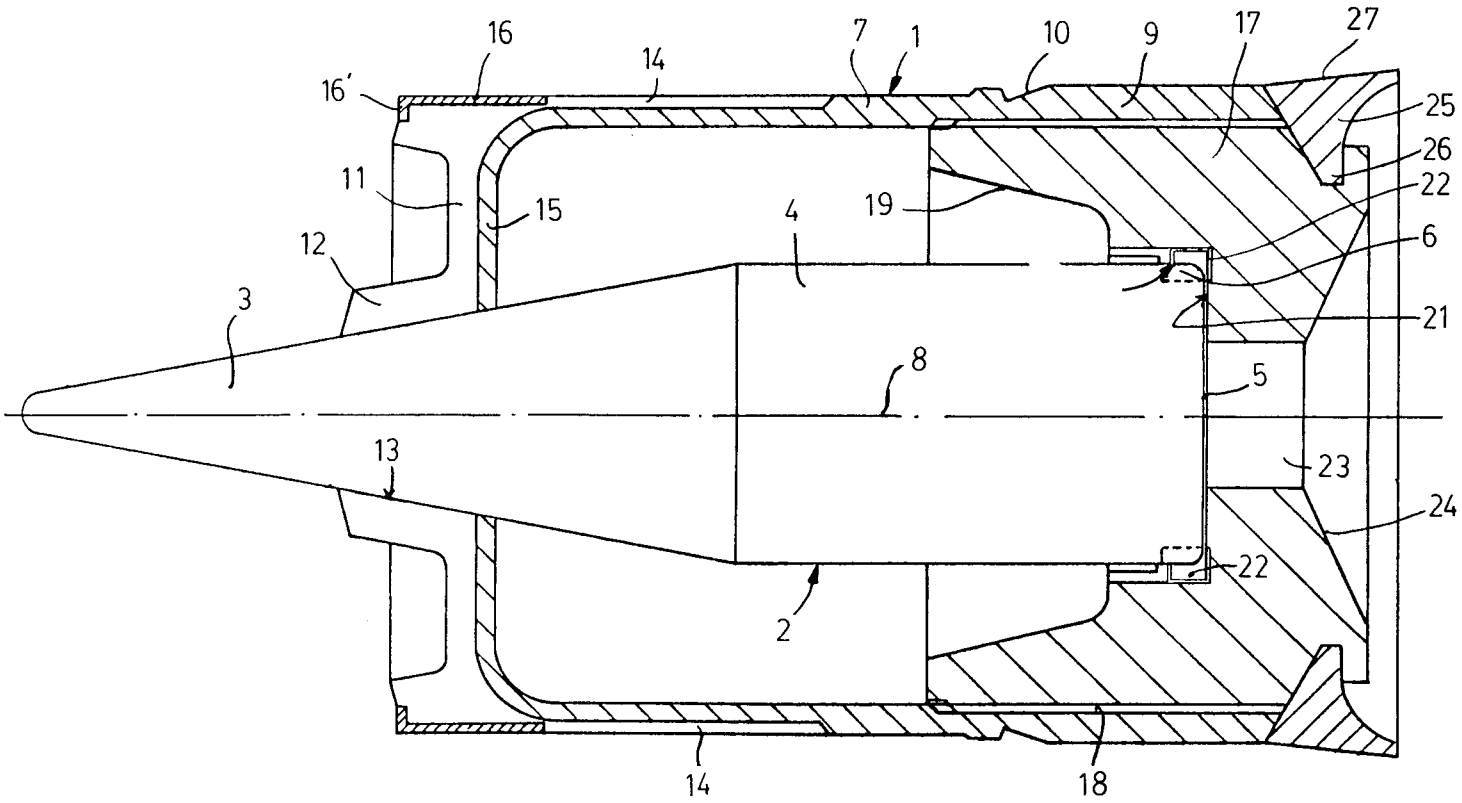
25
26
22
6
21
24
27
23
17
5
22
9
18
10
19
8
1
7
4
2
14
14
15
16
13
16'
11
12
3

DRIVE ELEMENT FOR A SUB-CALIBRE PROJECTILE

TECHNICAL FIELD

The present invention relates to a drive element for a sub-calibre spinning projectile which comprises a sabot member embracing the rear part of the projectile and a guiding sleeve substantially embracing the sabot member as well as the projectile body.

BACKGROUND ART

When firing a sub-calibre projectile from a gun barrel it is previously known to use annular sabots to bridge the annular gap between the projectile and the gun barrel. A typical sabot is then intended to achieve centering of the sub-calibre projectile in the barrel as well as the necessary obturation between the outer surface of the projectile and the inner surface of the barrel so that effective expulsion and spinning of the projectile from the firearm will be achieved.

As soon as the projectile has left the barrel the sabot has served its purpose and it should be separated from the projectile without unduly affecting the flight of the projectile. A sabot is therefore usually made in such a way that it is separated from the projectile due to the centrifugal forces, or the airflow forces, or both which act upon the sabot at the exit of the projectile from the muzzle of the barrel. For example the sabot can be made of a plurality of separate segments which are held together in the gun barrel but separated from each other at the exit of the projectile from the muzzle of the barrel. By the Swedish Pat. No. 74.10607-1 it is also previously known to make the sabot with a unitary body provided with a plurality of slots extending through the sabot and aligned parallel to its longitudinal axis and an unslotted portion which withstands the expulsion forces which act upon the projectile in the barrel at firing but which is mechanically weak so that it is broken by the centrifugal, or airflow forces or both which act upon the longitudinal sabot segments at the exit of the projectile from the muzzle of the barrel.

As sub-calibre projectiles in recent years have been used more and more, for instance against armour projected targets, it has also been more important that the sabots not only should be able to withstand the strong expulsion forces in the gun barrel but also should be simple to construct and manufacture for economical reasons. This relates to live as well as practice ammunition. The sabots should also be made of a light-weight material so that as large a part as possible of the expulsion gases are used for the expulsion of the sub-calibre projectile itself and also so that the handling of the ammunition units is facilitated. These requirements of a high strength and low manufacturing costs have been difficult to combine. The strength requirements cannot be reduced, if anything the strength requirements of the ammunition units (projectile with sabot) have increased due to the increase of muzzle velocity, and spin velocity as well as a more rapid ammunition handling procedure.

A further requirement of the sabots is that they should be designed in such a way that they can be automatically rammed into the firearm. Previously known sabots have been provided with a full caliber ring at the front end and at the rear end and an intermediate portion with reduced diameter. Such sabots, however, are not suitable for automatic ramming.

DISCLOSURE OF THE INVENTION

The object of the present invention is to provide a drive element in which such problems have been taken into consideration optimally. According to the invention the guiding sleeve is substantially cylindrical and of full caliber and provided with an external driving band made directly in the sleeve material and internal threads engaging corresponding external threads of the sabot member; the front part of the sabot member is provided with a central, axial hollow for the rear portion of the projectile, which hollow is provided with a plurality of axially protruding locking pins engaging corresponding recesses in the outer cylindrical surface of the projectile for securing the projectile to the sabot member.

In one preferred embodiment of the invention, the front part of the guiding sleeve is provided with a plurality of longitudinal slots made partially through the sleeve material, the front part of the slotted portion being held together by means of a guiding ring. The guiding sleeve is made of a high-strength material of low density, preferably made by moulding. The guiding ring, however, is preferably made of steel or other suitable material.

BRIEF DESCRIPTION OF THE DRAWING

In the following the invention will be more fully described with respect to a preferred embodiment illustrated in the accompanying drawing, in which the single FIGURE shows an elevational section view of a drive element according to the invention.

BEST MODE FOR CARRYING OUT THE INVENTION

A drive element 1 is shown for a sub-calibre spinning projectile 2 of the type generally comprising a conical nose section 3 and a cylindrical main body 4. At the rear, plane end surface 5 of the projectile the cylindrical outer surface of the projectile is provided with a plurality of symmetrically distributed recesses 6 for securing the projectile to the drive element in order to provide the projectile with the necessary spin. The number of recesses is two, three, four or more. The FIGURE illustrates two diametrically, opposite recesses 6. The projectile is either a live projectile or a practice projectile.

The drive element 1 comprises an outer, cylindrical full-caliber guiding sleeve 7 completely embracing the projectile body apart from the front portion of its conical section 3, so that its longitudinal axis coincides with the projectile axis 8. The guiding sleeve is arranged to be directly cooperating with the rifling of the barrel and is therefore provided with an outer driving band 9 formed directly in the sleeve material. The guiding sleeve is also provided with a small, conical portion 10 to facilitate the application of a cartridge case (not shown) on the projectile.

The guiding sleeve 7 is substantially formed as a hollow, cylindrical body with a straight, cylindrical portion in order to facilitate automatic ramming in the firearm and a cup-formed front surface 11 provided with a central, thicker portion 12 with an opening 13 corresponding to the front portion of the conical section 3 of the projectile. The guiding sleeve is also provided with a plurality of slots 14 extending in the longitudinal direction of the sleeve, i.e. parallel to the projectile axis 8. The slots are only made partially through the sleeve material to such a depth that a unitary part 15 of substantially uniform thickness formed by the end portion of the sleeve and the front portion of the cylindrical surface remains. The rear part of the cylindrical sleeve is unslotted and the driving band 9 and the conical portion 10 are made on this rear unslotted portion of the sleeve. It should be understood that the number of slots can be varied, but in this embodiment it is four slots. The object of the slots is to concentrate the breaking stresses of the material so as to facilitate the separation of the drive element into a number of smaller fractions at the exit of the barrel when the drive element is affected by centrifugal, or airflow forces or both.

In order to make the guiding sleeve sufficiently strong during the expulsion of the projectile in the gun barrel and also to facilitate the centering of the sleeve within the barrel to prevent any obliquity, the front part of the slotted portion of the guiding sleeve is provided with a guiding ring 16, preferably made of steel, embedded in the cylindrical sleeve wall. The guiding ring is provided with a right-angled flange 16' embedded in the cup-formed front surface 11.

Like the guiding sleeve the guiding ring 16 itself is also provided with indications of breaking up the ring in the form of slots, preferably made in the front flange 16' of the ring.

The drive element 1 is also provided with an annular sabot member 17 applied on the rear part of the projectile so that its symmetrical axis coincides with the projectile axis 8. The sabot member is provided with external threads 18 coacting with corresponding internal threads on the rear part of the guiding sleeve. Said threads are preferably chosen in such a way that when the projectile rotates in the gun barrel, the guiding sleeve 7 will be screwed harder onto the sabot member 17.

As illustrated in the FIGURE the forward end surface 19 of the sabot member is cup-formed to facilitate the separation of the sabot member from the projectile at the exit from the muzzle of the gun barrel and it is furthermore provided, with a central, axial hollow 20 for the rear part of the projectile. The hollow 20 is provided with a planar bottom part 21 engaging the planar rear end surface 5 of the projectile. The hollow 20 is also provided with a number of locking pins 22 extending in the axial direction and engaging the recesses 6 of the rear part of the projectile to secure the projectile to the sabot so that the necessary spin is imparted to the projectile on firing. As the locking pins are distributed around the periphery of the projectile, a very strong connection is obtained between the projectile and the sabot member which minimizes the risk of slipping even at very high spin velocities. In the present embodiment four locking pins are symmetrically distributed around the periphery but it should be understood that also another number of locking pins, for instance 3 or 6, could be used. Thanks to the planar end surface 5 of the projectiles, a good contact is obtained between the projectile and the sabot member which facilitates the expulsion of the projectile out of the gun barrel.

Furthermore the planar end surface has a favourable influence on the separation of the drive element from the sub-calibre projectile at the exit from the barrel. The sabot member is separated from the projectile as soon as the projectile has left the muzzle of the barrel as the airflow forces which act upon the sabot member are much higher than the airflow forces which act upon the projectile itself. Due to the planar contact surface between the sabot member and the projectile a momentary and undisturbed separation is obtained.

The sabot member 17 is also provided with a central, through hollow 23 to allow the expulsion gases to act upon the rear end surface 5 of the projectile. The backward extending surface 24 of the sabot member is substantially planar or slightly conical.

In order to obtain the necessary obturation between the outer surface of the projectile and the inner surface of the barrel so that an effective expulsion of the projectile from the firearm will be achieved, the rear part of the sabot member is provided with a sealing ring 25 made of rubber having a small inner part 26 attached in an annular recess in the rear part of the sabot member and an outer conical part 27 extending backwards and substantially in line with the cylindrical outer surface of the guiding sleeve.

The entire drive element is made of a high-strength material of low density. The guiding sleeve is preferably made of a moulded polyamide reinforced by glass fibre and the sabot member is preferably made of aluminium. This means that the weight of the driving element is low and also that it is comparatively simple to manufacture.

The invention is not limited to the illustrated embodiment but can be varied within the scope of the following claims.

I claim:

1. An improved drive element for a sub-calibre spinning projectile of the type having a conical nose section and a cylindrical main body, said drive element comprising:

a full-calibre, cylindrical guide sleeve having a longitudinal axis and a forward facing cup-formed front wall means extending transversely to said axis for increasing air flow forces acting on said drive element upon exit from a gun barrel, said front wall means comprising an axially extending opening for receiving the nose section of such a projectile; said guide sleeve further comprising a rearward facing hollow cylindrical wall means attached to said front wall for enclosing the cylindrical main body of such a projectile;

a plurality of circumferentially spaced slots running along a portion of the length of said cylindrical wall means and continuing across said front wall means to said opening, said slots extending only partially through the thickness of said cylindrical wall means and said front wall means to such a depth that a substantially uniform thickness remains in said front wall means and said cylindrical wall means at the bottoms of said slots, whereby air flow forces and centrifugal forces acting on said drive element after firing cause said front wall means and said cylindrical wall means to experience concentrated stress at said slots and to break into pieces to facilitate separation of such a projectile from said drive element;

a sabot member mounted within said cylindrical wall means of said guide sleeve, said sabot member comprising a cup-formed front surface having a central, rearwardly extending axial hollow for receiving the main body of such a projectile; and locking means within said axial hollow for engaging the main body of such a projectile to secure such a projectile to said sabot member.

2. A drive element according to claim 1, wherein said sabot member is threaded into said cylindrical wall means.

3. A drive element according to claim 2, wherein the front portion of said guide sleeve is held together by means of a guiding ring arranged on the forward end of said cylindrical wall means.

4. A drive element according to claim 3, wherein said guiding ring is embedded in said forward end of said cylindrical wall means.

5. A drive element according to claim 1, wherein said locking means comprise a plurality of pins in said axial hollow for engaging corresponding recesses in the cylindrical main body of such a projectile.

* * * * *